United States Patent [19]

Butler

[11] 4,201,182

[45] May 6, 1980

[54] COMPOUND BOW

[75] Inventor: Dennis L. Butler, Wilmington, Ill.

[73] Assignee: Bass Research and Design, Inc., Joliet, Ill.

[21] Appl. No.: 787,912

[22] Filed: Apr. 15, 1977

[51] Int. Cl.[2] ..... A41B 5/00

[52] U.S. Cl. ..... 124/24 R; 124/88

[58] Field of Search ..... 124/23 R, 24 R, 41 A, 124/88, 90, 86, 25 R

[56] References Cited

U.S. PATENT DOCUMENTS

| | | | |
|---|---|---|---|
| 3,674,001 | 7/1972 | Hitt | 124/24 R |
| 3,812,835 | 5/1974 | Smith | 124/24 R |
| 3,967,609 | 7/1976 | Frydenlund | 124/24 R |
| 3,981,290 | 9/1976 | Islas | 124/24 R |
| 3,987,777 | 10/1976 | Darlington | 124/86 X |
| 3,989,026 | 11/1976 | Nishioka | 124/24 R |

*Primary Examiner*—William R. Browne
*Attorney, Agent, or Firm*—Ernest Kettelson

[57] ABSTRACT

A bow of the compound type for use in archery, having an upper and lower limb pivotally mounted at opposite ends of an elongated central frame member having a hand grasp portion formed thereon. First and second pivot members having continuously variable leverage characteristics are each connected to both the upper and lower limbs. When the drawstring is pulled back toward the cocked position, the limbs pivot and the variable leverage pivot members rotate from the position of least leverage to positions of progressively greater leverage. Thus, less force is required as the drawstring approaches the fully cocked position. When the drawstring is released, the variable leverage pivot members operate in reverse to progressively increase the velocity of the drawstring as it snaps from the cocked to the fully released position.

23 Claims, 3 Drawing Figures

COMPOUND BOW

BACKGROUND OF THE INVENTION

This invention relates to the field of archery bows of the so-called compound type in which some kind of mechanism is provided to progressively reduce the resistance of the drawstring as it is pulled back to the fully cocked position and conversely to progressively increase the force of the drawstring when released to snap back to the fully released position. Examples of prior art bows of this kind are disclosed in the following U.S. Patents, No. 3,486,495 to Allen dated Dec. 30, 1969; No. 3,744,473 to Nishioka dated July 10, 1973; No. 3,812,835 to Smith dated May 28, 1974; No. 3,851,638 to Alexander dated Dec. 3, 1974; No. 3,854,467 to Hofmeister dated Dec. 17, 1974; No. 3,923,035 to Trotter dated Dec. 2, 1975; No. 3,923,036 to Jennings et al dated Dec. 2, 1975; No. 3,945,368 to Jones dated Mar. 23, 1976; No. 3,958,551 to Ketchum dated May 25, 1976; No. 3,967,609 to Frydenlund dated July 6, 1976 and No. 3,981,290 to Islas dated Sept. 21, 1976.

The prior art compound bows generally utilize an arrangement of pulleys by which to accomplish a reduction of drawstring resistance, and this in turn requires some means to synchronize the rotation of the pulleys which are associated with the upper and lower limbs of the bow. Such synchronization generally took the form of connecting the pulley mechanism which was mounted on one limb to the other limb at some intermediate anchor point by means of a line or cable under tension.

The present invention does not use a pulley mechanism, but employs pivot members which rotate less than a full turn from their position when the drawstring is fully released to their position when the drawstring is fully drawn and the bow cocked. The pivot members act both as a variable leverage mechanism and as a synchronization mechanism. In accordance with this invention, each pivot member applies variable leverage to both limbs. The result is an improved compound bow over those in the prior art, and one that performs the variable leverage and synchronization functions with a simplified less expensive mechanism.

SUMMARY OF THE INVENTION

It is an object of the invention to provide a compound bow having a variable leverage mechanism to vary the resistance on the drawstring from relatively greater resistance when in the fully released position to relatively lesser resistance when in the fully drawn position.

It is an object of the invention to provide a compound bow having a variable leverage mechanism comprising a pair of pivot members each connected to apply leverage to both the upper and lower limbs of the bow.

It is an object of the invention to provide a compound bow having a variable leverage mechanism which also functions as a synchronizing mechanism.

DESCRIPTION OF PREFERRED EMBODIMENT

Figure 1:
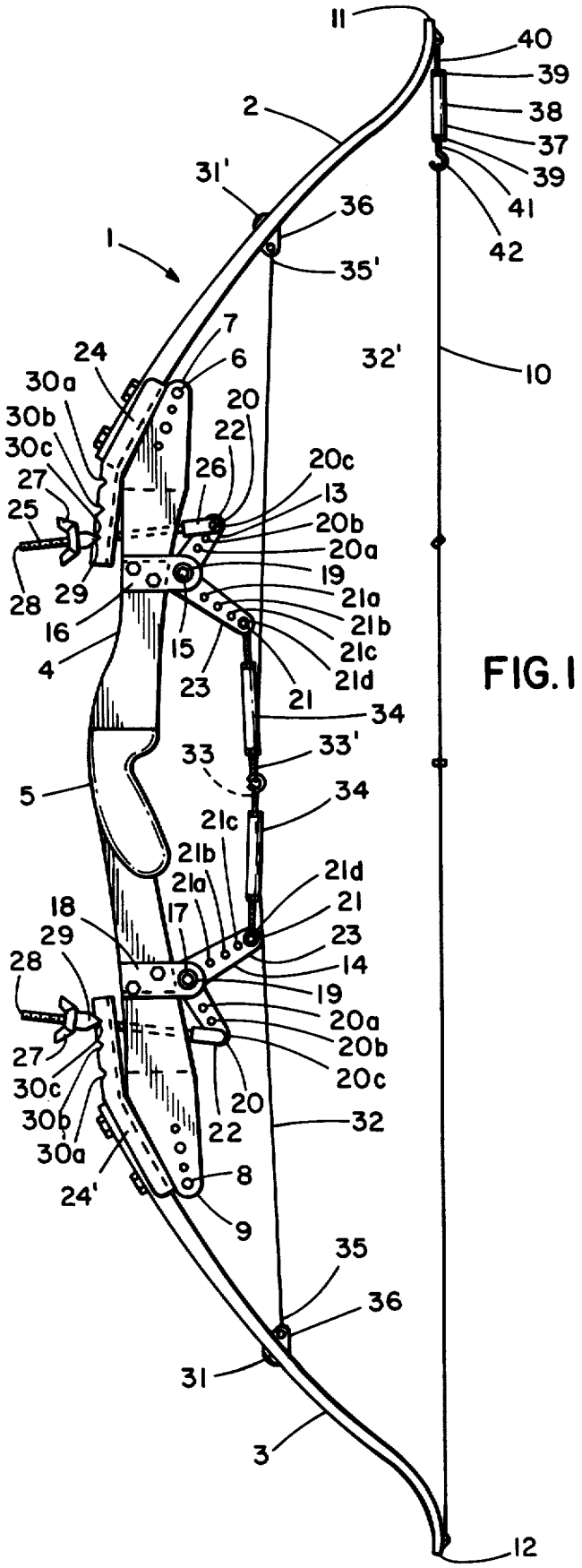
FIG. 1 is a side elevation view of a compound bow in accordance with this invention showing the bowstring in the fully released position.
Figure 3:
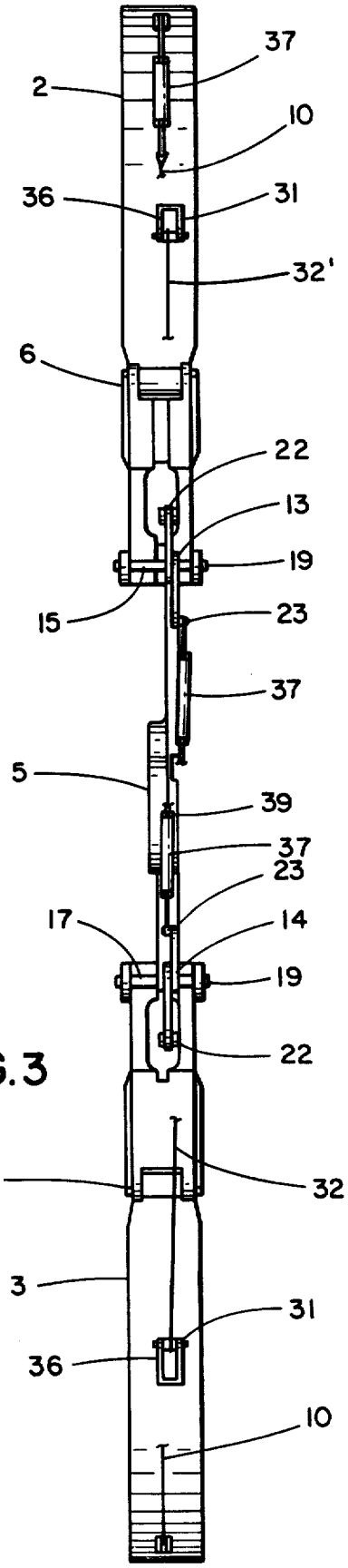
FIG. 3 is a rear elevation view of the compound bow in accordance with this invention.

A compound bow 1 in accordance with this invention includes an upper limb 2 and a lower limb 3. Each is pivotally mounted on an elongated frame member 4 having a hand grasp section 5 formed thereon. Upper limb 2 is pivotally mounted on pivot pin 6 to the upper end 7 of frame member 4, and lower limb 3 is pivotally mounted on pivot pin 8 to the lower end 9 of frame member 4.

A bowstring 10 is connected between outer end 11 of upper limb 2 and outer end 12 of lower limb 3. The upper and lower limbs 2 and 3 are preferably arcuate in configuration and are resilient so they flex when the bowstring is drawn in addition to pivoting on the respective pivot pins 6 and 8.

The elongated frame member 4 includes a pair of pivot members 13 and 14 mounted at spaced apart locations thereon. Pivot member 13 is mounted on a pivot pin 15 carried by bracket 16 affixed to frame member 4 at a location spaced inwardly from its upper end 7 and above the hand grasp section 5. Pivot member 14 is mounted on a pivot pin 17 carried by a bracket 18 affixed to frame member 4 at a location spaced inwardly from its lower end 9 and below the hand grasp section 5.

Each pivot member 13 and 14 are substantially identical, and to the extent they are, only one will be described in detail.

The pivot members 13 and 14 include an axial pivot point 19 and two radially extending anchor points 20 and 21 angularly displaced from each other. Anchor point 20 is represented by any one of a plurality of apertures **20*a*, 20*b* and 20*c* positioned along a first radial arm 22 at different distances from the axial pivot point 19. The aperture selected as between 20*a*, 20*b* and 20*c* for anchor point 20 depends on the leverage desired and to be applied to radial arm 22**.

Anchor point 21 is represented by any one of a plurality of apertures **21*a*, 21*b*, 21*c* and 21*d* positioned along a second radial arm 23 at different distances from the axial pivot point 19. The aperture selected as between 21*a*, 21*b*, 21*c* and 21*d* for anchor point 21 depends on the leverage desired and to be applied by radial arm 23 to the limb 2 or 3** to which it is connected.

Pivot member 13 is connected to upper limb 2 at its innermost end member 24 by means of an adjustable link rod 25, one end 26 of which is pivotally anchored in a selected one of the apertures **20*a*, 20*b* or 20*c* of radial arm 22. An adjustable anchor lug 27 is threadedly mounted on the link rod 25 from the other end 28, the adjustable anchor lug having a tapered end 29 which seats in a selected one of the notches 30*a*, 30*b* or 30*c* of innermost limb end member 24**.

Pivot member 14 is similarly connected to lower limb 3 at its innermost end member 24' by means of an adjustable link rod 25' as described above with respect to end member 24 and link rod 25.

Pivot member 13 which is positioned above the hand grasp section 5 of frame member 4 is connected to the limb on the opposite side of, or below, the hand grasp section 5 of frame member 4, namely to lower limb 3 at an intermediate point 31 thereon, by means of a cord 32 extending therebetween under tension. The cord 32 is connected at end 33 to an adjustable tension lug 34 which in turn is pivotally anchored in a selected one of apertures 21*a*, 21*b*, 21*c* or 21*d* of radial arm 23. The cord 32 is connected at end 35 to a bracket 36 secured to lower limb 3 at intermediate point 31.

Pivot member 14 which is positioned below the hand grasp section 5 of frame member 4 is similarly connected to the limb on the opposite side of, or above, the hand grasp section 5 of frame member 4, namely upper limb 2 at an intermediate point 31' thereon, by means of a cord 32' extending therebetween under tension. Cord 32' is similarly connected at end 33' to an adjustable tension lug 34 which in turn is pivotally anchored in a selected one of apertures 21*a*, 21*b*, 21*c* or 21*d* of radial arm 23 of pivot member 14. The cord 32' is connected at end 35' to a bracket 36 secured to upper limb 2 at intermediate point 31 thereon.

Bowstring 10 is connected to outer end 11 of upper limb 2 by means of an adjustable tension lug 37, similar to adjustable tension lugs 34.

The adjustable tension lugs 34 and 37 include an intermediate tubular section 38 having internally threaded nuts 39 secured at each opposite end. A first threaded shank 40 extends from one end having an anchorable outer end for pivotally anchoring in an aperture of radial arm 23 of pivot members 13 or 14, or of the outer end 11 of the upper limb 2. A second threaded shank 41 extends from the opposite end of the tubular section 38 having a hook 42 formed on its outer end on which a loop in the end of cords 32 or 32' or of bowstring 10 may be hooked. The tension on cords 32 and 32', and on bowstring 10 may thus be adjusted by rotating the internally threaded nuts 39 relative to the shanks 40 and 41 threadedly received therein, whereby the shanks are retracted into or extended from the tubular section 38.

In the fully released position, pivot members 13 and 14 are positioned and adjusted with respect to the upper and lower limbs 2 and 3 to which they are connected so that relatively greater distance and relatively less leverage is exerted by the pivot members 13 and 14 during the initial stages of rotation upon pulling of the bowstring 10 towards its drawn or cocked position. Such position of pivot members 13 and 14 may be described as follows. The first radial arm 22 of pivot member 13 is rotated to an at rest or released position which points approximately to one o'clock as shown in FIG. 1 and the first radial arm 22 of pivot member 14 to approximately five o'clock. When the bowstring 10 is drawn back towards the cocked position, upper limb 2 and lower limb 3 begin to pivot on pivot pins 6 and 8 respectively causing the inner end members 24 and 24' to move outwardly from the central elongated frame member 4. As they move outwardly, the link rods 25 and 25' begin to rotate radial arm 22 of pivot member 13 counterclockwise from the one o'clock toward the twelve o'clock position and radial arm 22 of pivot member 14 clockwise from the five o'clock toward the six o'clock position.

Figure 2:
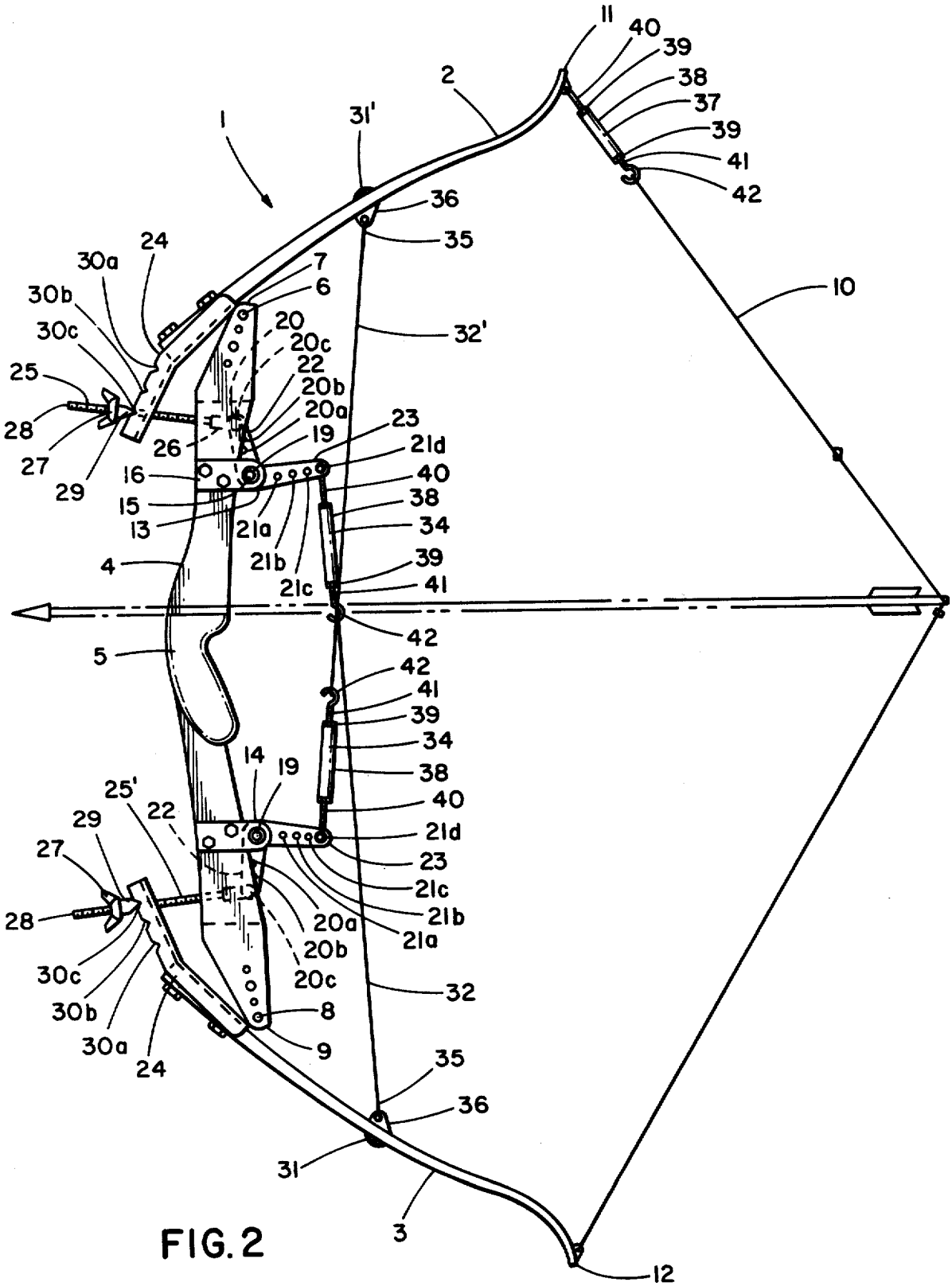
FIG. 2 is a side elevation view of the compound bow of FIG. 1 but with the bowstring shown in the fully drawn position.

The position of the link rods 25 and 25' at rest or in the fully released position of the bowstring is described as follows. The adjustable anchor lugs 27 anchored to the inner end members 24 and 24' of the limbs 2 and 3 lie relatively closer to a horizontal plane through the pivot points 19 of pivot members 13 and 14 when bowstring 10 is in the released position and they move to a relatively more remote location from such horizontal planes when the bowstring 10 is fully drawn to the cocked position. The horizontal planes through pivot points 19 of pivot members 13 and 14 as referred to in this paragraph are horizontal when the bow 1 is held in its upright position by an archer ready for shooting, or as shown in FIGS. 1 and 2.

Furthermore, when in the released position of the bow, radial arms 22 of pivot members 13 and 14 form an acute angle with their respective link rods 25 and 25'. When in the cocked or drawn position of the bow, the link rods 25 and 25' extend at right angles or at slightly obtuse angles to their respective radial arms 22.

Such relative positioning of the radial arms 22 of pivot members 13 and 14, and of the anchor lugs 27 of link rods 25 and 25' provide a variable leverage mechanism which produces relatively less leverage when in the fully released position and relatively greater leverage when in the fully cocked position of the bowstring. As the radial arms 22 rotate respectively from the one o'clock to twelve o'clock and five o'clock to six o'clock positions, the apertures 20 in which link rods 25 and 25' are anchored begin to move outwardly from the respective horizontal planes through pivot points 19 referred to above. Such movement has the effect of lengthening of a lever when combined with similar outward movement of the anchor lugs 27 at the other end of the link rods 25 and 25' away from said horizontal planes. Such lengthening of the lever effect provides relatively greater leverage and correspondingly lesser distance as the radial arms 22 of pivot members 13 and 14 rotate toward their respective twelve and six o'clock positions when the bowstring is pulled toward its fully cocked position. Thus as the bowstring nears its fully cocked position, the greatest leverage is provided and relatively less force is required to hold the bowstring 10 in the fully drawn or cocked position.

In addition to the variable leverage effect of radial arms 22 of pivot members 13 and 14, the radial arms 23 of said pivot members provide additional variable leverage as described below.

When the bowstring 10 is in its fully released position, radial arm 23 of pivot member 13 is in approximately the four o'clock position as shown in FIG. 1. When the bowstring is in its fully cocked position as shown in FIG. 2, the radial arm 23 of pivot member 13 is rotated to approximately the three o'clock position, or between the two and three o'clock position. The cord 32 is anchored to radial arm 23 at one end and to intermediate point 31 of lower limb 3 at the other end along a generally vertical line. At rest or in the fully released position of bowstring 10, the cord 32 and its anchor points to radial arm 23 and lower limb 3 are relatively closer to a vertical plane through pivot points 19 of pivot members 13 and 14 as shown in FIG. 1 than when the bowstring has been fully drawn as shown in FIG. 2. As radial arm 23 rotates from its at rest four o'clock position towards its approximately three o'clock position, the apertures 21 to which one end of cord 32 is anchored begins to move outwardly from the vertical plane through pivot points 19. Such outward movement has the effect of lengthening of a lever, thus providing progressively greater leverage on the lower limb 3 at intermediate point 31 through the cord 32 as the bowstring is pulled towards its fully drawn or cocked position. When the bowstring is fully drawn and radial arm 23 lies at about the three o'clock position as shown in FIG. 2, or between the two and three o'clock position, the greatest leverage is provided and relatively less force is required to hold the bowstring 10 in the fully drawn or cocked position.

The radial arm 23 of pivot member 14 acts in similar manner to provide variable leverage on upper limb 2 to which it is connected by cord 32'. Its position when the bow is in the released position is at approximately the two o'clock position, and when fully drawn the radial arm 23 of pivot member 14 is rotated to the three o'clock position, or slightly beyond to between the three and four o'clock position as shown in FIG. 2.

Furthermore, when in the released position of the bow, radial arms 23 of pivot members 13 and 14 extend at obtuse angles to their respective cords 32 and 32'. When in the cocked or drawn position of the bow, the cords 32 and 32' extend at right angles or at slightly acute angles to their respective radial arms 23.

Thus, the pivot members 13 and 14 as described herein, together with their cooperating components, each provide a double variable leverage effect on the upper and lower limbs 2 and 3 as the bowstring is pulled back from its released position to its cocked position to progressively reduce the force required to pull the drawstring as it nears the fully cocked positions and to reduce the force required to hold it in the fully cocked position.

Conversely, when the cocked bowstring is released, the pivot members 13 and 14 together with their associated linkages to the limbs 2 and 3, apply progressively greater force and velocity to the bowstring as the pivot members 13 and 14 rotate from their positions of greater leverage (and corresponding lesser distance) toward those positions of lesser leverage and correspondingly greater distance. Thus as they approach their respective at rest positions, progressively greater distance for each instant of time is transmitted to the upper and lower limbs and on to the bowstring causing it to progressively accelerate as it moves toward its fully released position. In such manner, greater velocity is imparted to an arrow by the bowstring as it snaps back under progressively accelerating forces of the pivot members 13 and 14 from its cocked to released position. The flexible upper and lower limbs 2 and 3 provide additional acceleration force to the arrow when the bowstring is released from its cocked position, in that when the bowstring is drawn back it causes the upper and lower limbs to flex in addition to pivoting. In the flexed position, the upper and lower limbs 2 and 3 serve as a stored energy mechanism which is applied to the arrow through the bowstring when it is released. I claim:

1. A compound bow, comprising limb means movable between a released position and a cocked position, bowstring means connected to said limb means to move said limb means from said released position to said cocked position when drawn, and variable leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to said first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, wherein when viewed from one side said first anchor point of said first pivot member is at approximately the one o'clock position in relation to its pivotal axis when said bowstring means is in its released position and said first anchor point of said second pivot member is at approximately the five o'clock position in relation to its pivotal axis when said bowstring means is in its released position.

2. A compound bow, comprising limb means movable between a released position and a cocked position, bowstring means connected to said limb means to move said limb means from said released position to said cocked position when drawn, and variable leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to aid first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, wherein when viewed from one side said first anchor point of said first pivot member is at approximately the twelve o'clock position in relation to its pivotal axis when said bowstring means is in its drawn position and said first anchor point of said second pivot member is at approximately the six o'clock position in relation to its pivotal axis when said bowstring means is in its drawn position.

3. A compound bow, comprising limb means movable between a released position and a cocked position, bowstring means connected to said limb means to move said limb means from said released position to said cocked position when drawn, and variable leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to said first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, wherein when viewed from one side said second anchor point of said first pivot member is at approximately the four o'clock position in relation to its pivotal axis when said bowstring means is in its released position and said second anchor point of said second pivot member is at approximately the two o'clock position in relation to its pivotal axis when said bowstring means is in its released position.

4. A compound bow, comprising limb means movable between a released position and a cocked position, bowstring means connected to said limb means to move said limb means from said released position to said cocked position when drawn, and variable leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to said first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, wherein when viewed from one side said second anchor point of said first pivot member is at approximately the three o'clock position in relation to its pivotal axis when said bowstring means is in its drawn position and said second anchor point of said second pivot member is at approximately the three o'clock position in relation to its pivotal axis when said bowstring means is in its drawn position.

5. A compound bow as set forth in claim 4, wherein said first and second limb members are arcuate in configuration.

6. A compound bow as set forth in claim 4, wherein said first and second limb members are resilient and flex when moved to said cocked position by said bowstring means.

7. A compound bow, comprising limb means movable between a released position and cocked position, bowstring means connected to said limb means to move said limb means from said released position to said cocked position when drawn, and varible leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to said first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, first link means to connect said first limb member directly to said first anchor point of said first pivot member, second link means to connect said second limb member directly to said first anchor point of said second pivot member, third link means to connect said second limb member directly to said second anchor point of said first pivot member, and fourth link means to connect said first limb member directly to said second anchor point of said second pivot member, wherein said first and second link means each includes a first link member one end of which is anchored at said first anchor point of respective ones of said pivot members, the opposite end of said first link member being connected to the inner end region of respective ones of said limb members, said third and fourth link means each include a second link member extending between said second anchor point of respective ones of said pivot members and an intermediate point of respective ones of said limb members, including a first plane of reference extending through the pivotal axes of both of said first and second pivot members, a second plane of reference extending through the pivotal axis of said first pivot member at right angles to said first plane of reference, a third plane of reference extending through the pivotal axis of said second pivot member at right angles to said first plane of reference, said first and second link means being respectively on the outboard side of said second and third planes of reference and spaced respectively therefrom, said first and second link means being relatively closer to said second and third planes respectively when said bowstring means is in its released position and relatively farther therefrom when said bowstring means is in its drawn position.

8. A compound bow as set forth in claim 7, wherein said third and fourth link means are on the bowstring side of said first plane of reference and relatively closer to said first plane of reference when said bowstring is in its released position and relatively farther therefrom when said bowstring is in its drawn position.

9. A compound bow as set forth in claim 7, wherein said first link member is a link rod, one end of which is pivotally anchored at said first anchor point of respective ones of said first and second pivot members, and said second link member is a cord extending under tension between said second anchor point of respective ones of said pivot members and said intermediate point of respective ones of said limb members.

10. A compound bow, comprising limb means movable between a released position and a cocked position, bowstring means connected to said limb means to move said limb means from said released position to said cocked position when drawn, and variable leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to said first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, first link means to connect said first limb member directly to said first anchor point of said first pivot member, second link means to connect said second limb member directly to said first anchor point of said second pivot member, third link means to connect said second limb member directly to said second anchor point of said first pivot member, and fourth link means to connect said first limb member directly to said second anchor point of said second pivot member, wherein said first and second link means each include a first link member one end of which is anchored at said first anchor point of respective ones of said pivot members, the opposite end of said first link member being connected to the inner end region of respective ones of said limb members, said third and fourth link means each include a second link member extending between said second anchor point of respective ones of said pivot members and an intermediate point of respective ones of said limb members, wherein said first link members of said first and second link means extend at acute angles to the first radii of said first and second pivot members to which they are respectively anchored when said bowstring means is in its released position and said first link members extend at other than an acute angle to said radii when said bowstring means is in its drawn position.

11. A compound bow as set forth in claim 10, wherein said angle which is other than an acute angle is an obtuse angle.

12. A compound bow as set forth in claim 10, wherein said angle which is other than an acute angle is a right angle.

13. A compound bow, comprising limb means movable between a released position and a cocked position, bowstring means connected to said limb means to move said limb means from said released position to said cocked position when drawn, variable leverage means connected to said limb means to apply variable leverage force on at least two points on said limb means as it is moved from said released to said cocked position, wherein said limb means includes a centrally disposed elongated frame member having a hand grasp section thereon, first and second limb members, said first limb member being mounted on said elongated frame member at one side of said hand grasp section thereof, said second limb member being pivotally mounted on said elongated frame member at the opposite side of said hand grasp section, wherein said variable leverage means includes first and second pivot members each having a pivotal axis, said pivot members each including a first anchor point spaced radially from said pivotal axis along a first radius, a second anchor point spaced radially from said pivotal axis along a second radius angularly displaced from said first radius, said first limb member being directly connected to said first anchor point of said first pivot member, first direct connecting means extending in a substantially straight line between the point of connection to said first limb member and said first anchor point of said first pivot member, said second limb member being directly connected to said second anchor point of said first pivot member, second direct connecting means extending in a substantially straight line between the point of connection to said second limb member and said second anchor point of said first pivot member, said second limb member being directly connected to said first anchor point of said second pivot member, third direct connecting means extending in a substantially straight line between the point of connection to said second limb member and said first anchor point of said second pivot member, said first limb member being directly connected to said second anchor point of said second pivot member, and fourth direct connecting means extending in a substantially straight line between the point of connection to said first limb member and said second anchor point of said second pivot member, first link means to connect said first limb member to said first anchor point of said first pivot member, second link means to connect said second limb member to said first anchor point of said second pivot member, third link means to connect said second limb member to said second anchor point of said first pivot member, and fourth link means to connect said first limb member to said second anchor point of said second pivot member, wherein said first and second link means each include a first link member one end of which is anchored at said first anchor point of respective ones of said pivot members, the opposite end of said first link member being connected to the inner end region of respective ones of said limb members, said third and fourth link means each include a second link member extending between said second anchor point of respective ones of said pivot members and an intermediate point of respective ones of said limb members, wherein said second link members of said third and fourth link means extend at obtuse angles to the second radii of said first and second pivot members to which said second link members are respectively connected when said bowstring means is in its released position and said second link members extend at other than an obtuse angle to said radii when said bowstring means is in its drawn position.

14. A compound bow as set forth in claim 13, wherein said angle which is other than an obtuse angle is an acute angle.

15. A compound bow as set forth in claim 13, wherein said angle which is other than an obtuse angle is a right angle.

16. A compound bow, comprising limb means movable between a released position and a cocked position, bowstring means connected to said limb means to move said limb means from said released position to said cocked position when drawn, and variable leverage means connected to said limb means to apply variable leverage force on said limb means as it is moved from said released to said cocked position, wherein said variable leverage means includes first and second pivot members mounted in spaced apart relationship on said bow, said pivot members each including a pivotal axis, a first anchor point spaced radially from said pivotal axis along a first radius and a second anchor point spaced radially from said pivotal axis along a second radius angularly disposed from said first radius, said limb means including first and second limb members, said first limb member being directly connected to said first anchor point of said first pivot member, first direct connecting means including a first link means extending in a substantially straight line between the point of connection to said first limb member and said first anchor point of said first pivot member, said second limb member being directly connected to said second anchor point of said first pivot member, second direct connecting means including a second link means extending in a substantially straight line between the point of connection to said second limb member and said second anchor point of said first pivot member, said second limb member being directly connected to said first anchor point of said second pivot member, third direct connecting means including a third link means extending in a substantially straight line between the point of connection to said second limb member and said first anchor point of said second pivot member, said first limb member being directly connected to said second anchor point of said second pivot member, and fourth direct connecting means including a fourth link means extending in a substantially straight line between the point of connection to said first limb member and said second anchor point of said second pivot member.

17. A compound bow as set forth in claim 16, wherein said first and third link means includes a link rod one end of which is pivotally anchored at said first anchor point of respective ones of said pivot members, the opposite end of said link rod being connected to the inner end region of respective ones of said limb members, said second and fourth link means includes a cord extending under tension between said second anchor point of respective ones of said pivot members and an intermediate point of respective ones of said limb members.

18. A compound bow as set forth in claim 17, wherein said limb means includes a centrally disposed elongated frame member having a hand grasp section thereof, said first limb member being pivotally mounted on said elongated frame member at one side of said hand grasp section thereof, said second limb member being pivotally mounted on said elongated frame member at the opposite side of the said hand grasp section, wherein said inner end region of said limb members is inwardly of the pivot point at which they are pivotally mounted respectively on said elongated frame member and said intermediate point of said limb members is outwardly of said pivot point.

19. A compound bow as set forth in claim 17, wherein said first and second link means are adjustable to vary the distance between their respective anchor points to respective pivot members and their respective connections to respective ones of said limb members.

20. A compound bow as set forth in claim 17, wherein said third and fourth link means include adjustable members connected to respective ones of said cords to vary the tension of said cords.

21. A compound bow, comprising limb means movable between a released position and a cocked position, bowstring means connected to said limb means to move said limb means from said released position to said cocked position when drawn, and leverage means connected to said limb means to apply resistive force to said limb means to resist movement thereof from said released position to said cocked position, including a limb mounting member, said limb means including a first limb member and a second limb member, said first and second limb members being pivotally mounted at single points respectively on said limb mounting member for pivotal movement of said limb members between said released position on said cocked position, said leverage means applying said resistive force to said pivotally mounted limb members to resist movement thereof from said released position to said cocked position, and said leverage means being connected to said mounting member and pivotable through an arc to aid in applying a variable force to the limb means when the limb means is drawn toward a cocked position.

22. A compound bow, comprising limb means movable between a released position and a cocked position, bowstring means connected to said limb means to move said limb means from said released position to said cocked position when drawn, lever means connected to said limb means to apply resistive force to said limb means to resist movement thereof from said released position to said cocked position, including a limb mounting member, said limb means including a first limb member and a second limb member, said first and second limb members being pivotally mounted at single points respectively on said limb mounting member for pivotal movement of said limb member between said released position and said cocked position, said lever means applying said resistive force to said pivotally mounted limb members to resist movement thereof from said released position to said cocked position, wherein said first and second limb members are resilient, and said lever means being connected to said mounting member and pivotable through an arc in applying a variable force to the limb means when the limb means is drawn toward a cocked position.

23. A compound bow, comprising limb means movable between a released position and a cocked position, bowstring means connected to said limb means to move said limb means from said released position to said cocked position when drawn, lever means connected to said limb means to apply resistive force to said limb means to resist movement thereof from said released position to said cocked position, including a limb mounting member, said limb means including a first limb member and a second limb member, said first and second limb members being pivotally mounted at single points respectively on said limb mounting member for pivotal movement of said limb member between said released position and said cocked position, said lever means applying said resistive force to said pivotally mounted limb members to resist movement thereof from said released position to said cocked position, wherein said limb mounting member includes a hand grasp portion, said first limb member being pivotally mounted on one side of said hand grasp portion, said second limb member being pivotally mounted on the opposite side of said hand grasp portion and said lever means being connected to said mounting member and pivotable through an arc in applying a variable force to the limb means when the limb means is drawn toward a cocked position.

* * * * *